United States Patent [19]

Nixon

[11] Patent Number: 4,554,871

[45] Date of Patent: Nov. 26, 1985

[54] DISPENSED GUIDED SUBMUNITION

[75] Inventor: Richard G. Nixon, Cedar Knolls, N.J.

[73] Assignee: Allied Corporation, Morris Township, Morris County, N.J.

[21] Appl. No.: 553,677

[22] Filed: Nov. 21, 1983

[51] Int. Cl.[4] ..... F42B 13/50

[52] U.S. Cl. ..... 102/489; 102/214; 102/357; 244/3.19

[58] Field of Search ..... 102/214, 384, 340, 342, 102/350, 357, 393, 489, 501; 244/3.1, 3.19, 3.23

[56] References Cited

U.S. PATENT DOCUMENTS

| | | | |
|---|---|---|---|
| 3,401,637 | 4/1968 | Briscoe | 102/501 |
| 3,727,554 | 4/1973 | Packard | 102/214 |
| 4,374,577 | 2/1983 | Brown | 244/3.23 |
| 4,492,166 | 1/1985 | Purcell | 244/3.22 |

*Primary Examiner*—Harold J. Tudor

*Attorney, Agent, or Firm*—Stanley N. Protigal

[57] ABSTRACT

A missile such as a projectile (11) carries at least two submunitions (13, 14) each of which has an active guidance capability. Each submunition (13, 14) has a forward end (21) which is slanted, creating an asymmetric shape for the submunition (13, 14). When the projectile (11) reaches a predetermined point in its trajectory, the submunitions (13, 14) are dispensed in a manner which causes the submunitions (13, 14) to acquire different flight paths. The guidance system on each submunition (13, 14) relies on the asymmetrical shape of the submunition (13, 14) to cause the submunition (13, 14) to precess about its center axis, thus creating an appropriate search pattern, such as a rosette search pattern. The asymmetric shape of the submunitions (13, 14) can also be used to control the flight path of the submunition (13, 14) after a suitable target has been acquired by the submunition's guidance system. The inventive arrangement gives the submunitions (13, 14) the ability to search, acquire, track, hit and defeat in a package with minimum dimensions and with minimum complexity.

17 Claims, 3 Drawing Figures

DISPENSED GUIDED SUBMUNITION

BACKGROUND OF THE INVENTION

This invention relates to ammunition, and more particularly to a submunition which is separated from at least one other submunition and which uses a guidance system in order to acquire a target.

Guided projectiles are becoming popular in enabling long range artillery to destroy specified targets while the artillery is located at a relatively safe location. In one pre-existing system, a single guided projectile was targeted to a high priority target, such as a tank, by using a laser designator. The system operates with and is dependent upon a forward observer who must illuminate the target with the laser designator to facilitate the guided projectile's guidance package in homing in on the target. The target illumination in turn compromises the safety and utility of the forward observer.

An alternative technique had been to place many potentially low cost submunitions into a target-rich impact area in a single volley. Unfortunately, this type of submunition has a capability of defeating only low priority targets. Another technique that has been proposed includes providing guided submunitions with parachutes in order that the submunitions may have a chance to seek and acquire appropriate targets. The guidance systems have moving parts which have to be secured, for example, during common launch and which tend to be expensive or unreliable. There is therefore a need to provide a system which can actively seek out a large number of high priority targets and which has a reasonably high lethality against these high priority targets.

The present invention has, as one of its objects, the provision of a projectile with multiple guided warhead-carrying submunitions which can be used to independently acquire high priority targets, such as tanks, and successfully defeat these types of targets, despite their heavy armor. It is therefore an object of the invention to provide a submunition which can be readily packaged in the compact space of, for example, a cannon launched projectile, and which can be provided with a guidance system which can readily acquire an appropriate target. It is a further object of the invention to provide a guided missile, such as a guided submunition, which has a capability of actively seeking its target, by using a search pattern and in which the search pattern is effected by the missile's movements.

It is a further object of the invention to provide a dropped submunition which is guided and yet does not require excessive target acquisition times, thereby eliminating the need for significantly slowing the submunition after it is approaching the target. This is important because it is desired that the submunition have a low visual signature to avoid destruction in the event that hostile forces should attempt to destroy it.

SUMMARY OF THE INVENTION

According to the present invention, a guided missile is dispensed from a housing, such as a projectile shell, preferably as one of at least a pair of submunitions which are nested against each other. A portion of each submunition, which is to become the forward end, is cut diagonally, typically across a cylindrical body shape. The diagonal cut in the cylindrical shape allows pairs of the submunitions to be nested against each other, thereby permitting compact spacing of the submunitions within the projectile shell. The diagonal cut presents a relatively large frontal area for use with guidance functions and functions as a control surface for creating a search pattern and maneuvering the submunition.

The search pattern is established by causing the submunition to rotate about its center axis at a given rate. The diagonal cut across the forward end causes the submunition to be tilted and the combination of the rotation and the tilting causes the center axis to precess. The submunition is provided with a seeker antenna, so that the rotation and precession results in a rosette scan pattern. When the submunition acquires an appropriate target, the submunition's guidance system can control the submunition by appropriate means, such as with control surfaces or by a simple reaction motor to rotate the submunition. The diagonal cut of the front end can then advantageously be used for trajectory control.

DETAILED DESCRIPTION OF THE PREFERRED EMBODIMENTS

Figure 1:
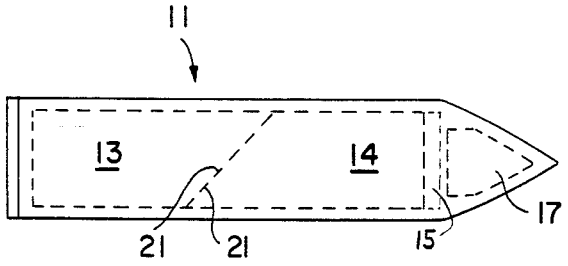
FIG. 1 shows a projectile housing a pair of submunitions constructed in accordance with the present invention.

Referring to FIG. 1, a missile 11 is used to launch a plurality of submunitions 13, 14, which are constructed in accordance with the invention. In the preferred embodiment, the missile 11 is a 155 mm projectile round, although the inventive concepts are equally applicable to other types of missiles. As can be seen, the submunitions 13, 14 are carried within the projectile round 11 as a payload to be ejected from the projectile round 11. The projectile round 11 follows a ballistic course, which is established in a more-or-less conventional manner in order to place the projectile round 11 over a selected target area when the submunitions 13, 14 are to be ejected. At a pre-selected time or altitude, the submunitions 13, 14 are ejected from the projectile round 11 so that they may fall and be guided to their targets.

The submunitions 13, 14 are ejected from the projectile round 11 with the aid of a propellant charge 15. A fuze 17 is used to ignite the charge 15 and initiate ejection. The ejection process can also be used to impart variations in spin rotation on the submunitions 13, 14 by use of keyways (not shown) on the submunitions 13, 14 and projectile body 11 to despin the submunitions 13, 14 and cause the submunitions to rotate in a predetermined manner while they are being ejected.

Figure 2:
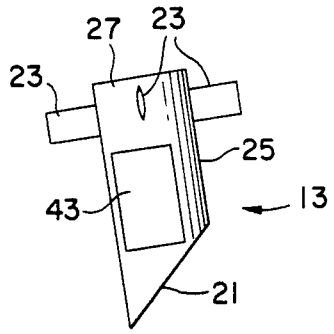
FIG. 2 shows one of the submunitions of FIG. 1 after it has been ejected from the projectile.
Figure 3:
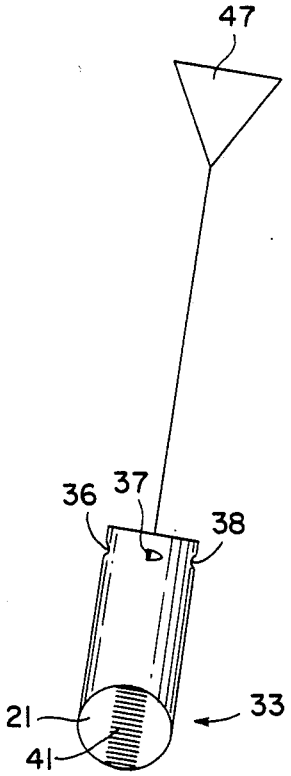
FIG. 3 shows an alternate embodiment of a submunition constructed in accordance with this invention.

Referring to FIG. 2, after ejection, the submunitions such as submunition 13, fall separately from the projectile round 11, although the momentum of projectile round 11 remains imparted on the submunitions 13, 14. The submunition 13 is generally cylindrical, having a forward end 21, which is cut at an angle. The forward end 21 preferably has a flat face which may be used to mount a stripline antenna 24, shown in FIG. 3, if required as a part of a sensor for a guidance system. Candidate sensors and guidance systems involve active and passive systems which may use radio frequency (RF) or infrared energy. Referring to FIG. 3, this flat face 21 has a larger cross-sectional area than the cross-sectional area of the submunition taken in a plane perpendicular to a submunition's center axis. This may be advantageous to the particular guidance antenna array chosen for this device.

A plurality of control fins 23 are deployed by folding away from the submunitions body 25. The control fins 23 function is to stabilize the submunition 13. The fins may also be moved in response to signals from a guidance system (not shown) which is contained in the submunition 13. While a squared-off tail section 27 is shown, it is also possible to use a different tail configuration, such as a tapered or rounded tail section (not shown).

Referring to FIG. 3, a submunition 33 is shown in which a reaction motor is used to effect guidance control. The reaction motor includes a plurality of openings 36–38 which control the spin of the submunition 33 by means of a gas ejected from the openings 36–38. Because of the angle at which the forward end 21 is cut, a large radial force exists creating motion perpendicular to body axis, and therefore, spin control of the submunitions 13 or 23 can be used in order to direct the submunition 13 or 33 to a selected target. It is, of course, also possible to use a reaction motor or control fins to redirect the submunition 13 or 33 without controlling the spin. The angled forward end 21 makes control of the submunition 13 or 33 a lot more facile by using the technique of rotating the submunition 13 or 33 about its center axis.

Referring to FIG. 3, while the submunition 33 is spinning about its longitudinal axis, the front end 21 causes the submunition 33 to change directions. When the submunition 33 is spinning at an appropriate speed, the tilting movement causes the submunition's longitudinal axis to precess. In order to effect guidance control, a sensor such as stripline antenna represented by parallel lines 41 is used to obtain signals from various possible targets. Such sensors must be able to scan a target area in order to acquire a target. Typically this scanning is effected by electronically or mechanically moving such a sensor in order to read signals from different parts or the target area. As a result of the precession of submunition's longitudinal axis while the submunition 33 is spinning, the fixed sensor 41 on the submunition 33 is moved with the submunition 33 in order to accomplish a rosette scan.

The submunition 33 includes equipment for obtaining rate information as part of its guidance system. Since the rate information provides an indication of the position of the submunition 33, it is not necessary to process additional information concerning the position of a moveable sensor, as no moveable sensor exists. It should be further noted that, since the forward end 21 is cut diagonally, it has a larger cross-sectional area than is possible even with a blunt nose. This allows certain types of sensors, such as the stripline sensor 41 shown, to occupy an increased area. It is, of course, also possible to provide fixed or moveable sensors on other parts of the submunition 33 as is appropriate for the particular mission of the submunition 33 and, more importantly, as appropriate for the guidance system of the submunition 33.

Referring to FIG. 2, the submunition 13 includes a shaped charge warhead 43. In the preferred embodiment, upon striking a target, the submunition 13 will form a shaped charge jet from the warhead 43 with sufficient energy to achieve a high probability of target defeat against an armored vehicle such as a tank. Since the submunition 13 is approaching the target from above, the warhead 43 may be relatively compact and need not occupy the full width of the submunition 13. For this reason, the warhead 43 may be positioned symmetrically in the body 25 of the submunition 13 in order to position the warhead 43 for maximum momentum in the anticipated vector direction of impact. Asymmetrical positioning of the warhead 43 may also accommodate guidance and control system packaging within the submunition.

The fact that the submunition 13 effects a rosette scan when it is acquiring a target substantially from above results in target acquisition being relatively uncomplicated, as compared to that encountered by a projectile approaching from a direction closer to the horizontal.

In order to enhance the lethality of the weapon system, it is important that the weapon system be able to provide a significant number of munitions which have a high probability of acquiring different targets and yet are likely to defeat high priority targets. The inventive system, by ejecting a plurality of submunitions, such as submunitions 13, 14 shown in FIG. 1, in which each submunition is likely to be over a different area, enables a substantial number of different targets to be defeated without using an excessively large number of primary projectiles.

The capability of the submunitions to rapidly acquire targets permits the submunitions to drop toward the target at a relatively rapid rate, rather than using parachutes or excessively large drogues, thus reducing the visual signatures of the submunitions and reducing the ability of an enemy to counter-attack the submunition. If it is determined that some means for slowing the submunition's descent rate is desireable, this could be effected by a drogue chute 47, as shown in FIG. 3. The drogue 47 also slows the submunition in its horizontal movement after ejection. In order to keep the visual signature of the submunition 33 to a minimum, the drogue 47 should be kept as small as possible without substantially deteriorating the submunition's performance.

As can be seen, the inventive concept allow for numerous variations in the design from those shown in the preferred embodiments. For example, it is possible to provide control of the flight path of the submunition 33 by application of reaction forces transverse to the submunition's center axis. It is also possible to combine a reaction motor, as shown in FIG. 3, with control fins, such as control fins 23 shown in FIG. 2. These and other modifications being possible, the invention should be read as limited only by the claims.

I claim:

1. Missile with a plurality of submunitions which are dispensed from the missile during the flight of the missile, wherein each submunition has a center axis, a forward end, and an aft end, said forward and aft ends defined by the general trajectory of the submunition after being dispensed, characterized in that:

said forward end on at least one of said submunitions has a forward surface which is slanted so that its relationship to that submunition's side wall is an acute angle on one side of the submunition and an obtuse angle on an opposite side of the submunition;

means are provided to induce the submunition to spin about its axis;

said submunition comprises a guidance system which includes a sensor, the spin of the projectile and the forward surface causing a movement of the projectile with the sensor and thereby establishes a scan pattern for the sensor.

2. Apparatus as described in claim 1, further characterized in that:

said forward surface is configured to cause the submunition's axis to precess, thereby establishing said scan pattern.

3. Apparatus as described in claim 2, further characterized in that:

said scan pattern is a rosette pattern.

4. Apparatus as described in claim 2, further characterized in that:

said sensor is in a substantially fixed relationship with respect to submunition prior to the guidance system acquiring a target.

5. Apparatus as described in claim 4, further characterized in that:

said sensor is an antenna provided on said forward surface.

6. Apparatus as described in claim 1, further characterized in that:

a plurality of fins are provided near the aft end of said submunition and the fins are positioned to direct the forward end ahead of the aft end in the submunition's movement.

7. Apparatus as described in claim 6, further characterized in that:

the fins control a spin rate of said submunition.

8. Apparatus as described in claim 1, further characterized in that:

said sensor is an antenna provided on said forward surface; and said antenna is used to provide signals to said guidance system.

9. Apparatus as described in claim 8, further characterized in that:

the antenna has at least one physical dimension which exceeds a diameter measurement of the submunition at the forward end.

10. Apparatus as described in claim 1, further characterized in that:

at least one pair of the submunitions are carried in said missile;

each of said submunitions in the pair has said forward surface;

said pair is carried in said missile in a position in which said forward surface of each of the pair of submunitions faces the other in an adjacent relationship.

11. Apparatus as described in claim 10, further characterized in that:

said missile carries a single pair of said submunitions.

12. Apparatus as described in claim 1, further characterized in that:

said missile is a projectile which is launched from a gun.

13. Missile with a plurality of submunitions which are dispensed from the missile during the flight of the missile, wherein each submunition has a center axis, a forward end, and an aft end, said forward and aft ends defined by the general trajectory of the submunition after being dispensed, characterized in that:

said forward end on at least one of said submunitions has a substantially flat surface which is slanted so that its relationship to that submunition's side wall is an acute angle on one side of the submunition and an obtuse angle on an opposite side of the submunition;

means are provided to induce the submunition to spin about its axis;

said submunition comprises a guidance system which includes a sensor, the grip of the projectile and the flat surface causing a movement of the projectile with the sensor and thereby establishes a scan pattern for the sensor.

14. Apparatus as described in claim 13, further characterized in that:

said flat surface is configured to cause the submunition's axis to precess, thereby establishing said scan pattern.

15. Apparatus as described in claim 14, further characterized in that:

said sensor is in a substantially fixed relationship with respect to submunition prior to the guidance system acquiring a target.

16. Apparatus as described in claim 13, further characterized in that:

said sensor is an antenna provided on said flat surface; and said antenna is used to provide signals to said guidance system.

17. Apparatus as described in claim 16, further characterized in that:

the antenna has at least one physical dimension which exceeds a diameter measurement of the submunition at the forward end.

* * * * *